US005890434A

United States Patent [19]

Nast

[11] Patent Number: 5,890,434

[45] Date of Patent: Apr. 6, 1999

[54] MOTOR BOGIE

[75] Inventor: Jean-Daniel Nast, Le Creusot, France

[73] Assignee: GEC Alsthom Transport SA, Paris, France

[21] Appl. No.: 852,059

[22] Filed: May 6, 1997

[30] Foreign Application Priority Data

May 7, 1996 [FR] France ..... 96 05718

[51] Int. Cl.[6] ..... B61F 5/00

[52] U.S. Cl. ..... 105/199.1

[58] Field of Search ..... 105/199.1, 199.2, 105/199.3, 200, 202, 208

[56] References Cited

U.S. PATENT DOCUMENTS

| | | | |
|---|---|---|---|
| 3,376,831 | 4/1968 | Eaton et al. | 105/199.1 |
| 3,802,350 | 4/1974 | Hicks et al. | 105/199.1 |
| 5,048,427 | 9/1991 | Dumoulin | 105/199.3 |
| 5,107,773 | 4/1992 | Daley et al. | 105/199.2 |
| 5,570,640 | 11/1996 | Kroesch | 105/199.1 |

FOREIGN PATENT DOCUMENTS

| | | | |
|---|---|---|---|
| 1206943 | 2/1960 | France . | |
| 1195792 | 7/1965 | Germany | 105/199.1 |
| DT1934478 | 1/1970 | Germany . | |
| DT1817141 | 7/1970 | Germany . | |
| 28065 | 1/1989 | Japan | 105/199.1 |

*Primary Examiner*—Mark T. Le

*Attorney, Agent, or Firm*—Sughrue, Mion, Zinn, Macpeak & Seas, PLLC

[57] ABSTRACT

A motor bogie includes a bogie chassis and a crossbeam. The crossbeam pivots about a vertical axis relative to the bogie chassis, bears on a side friction block and is rotationally coupled by links to a body mounted on the motor bogie. An additional coupling is provided between the chassis and the body by an anti-yaw damper.

4 Claims, 2 Drawing Sheets

MOTOR BOGIE

BACKGROUND OF THE INVENTION

Field of the Invention

The present invention concerns a motor bogie.

One aim of the invention is to provide a motor bogie in which the anti-yaw torque is obtained by means of a new architecture.

SUMMARY OF THE INVENTION

The invention consists in a motor bogie including a bogie chassis and a crossbeam, the crossbeam being adapted to pivot about a vertical axis relative to said bogie chassis, said crossbeam bearing on a side friction block and being rotationally coupled by links to a body mounted on said motor bogie, an additional coupling being provided between said chassis and said body by means of an anti-yaw damper.

The motor bogie of the invention also has at least one of the following features:

an anti-yaw torque is obtained by virtue of rotation of said chassis relative to said crossbeam by introducing into the chassis/body coupling a friction torque generated by said side friction block, the characteristic of said anti-yaw damper is adjusted for safe operation of said bogie, said anti-yaw torque is obtained by rubbing of said crossbeam on said side friction block, to which is added an additional anti-yaw torque produced by means of said anti-yaw damper if the relative angular speed between said body and said chassis exceeds a predetermined threshold.

One advantage of the motor bogie of the invention is that it guarantees safe operation in degraded situations without compromising comfort and the level of force under normal conditions of operation.

Other aims, features and advantages of the invention will emerge from a reading of the description of one preferred embodiment of a bogie of the invention given with reference to the accompanying drawings.

DETAILED DESCRIPTION OF THE PREFERRED EMBODIMENT

Figure 1:
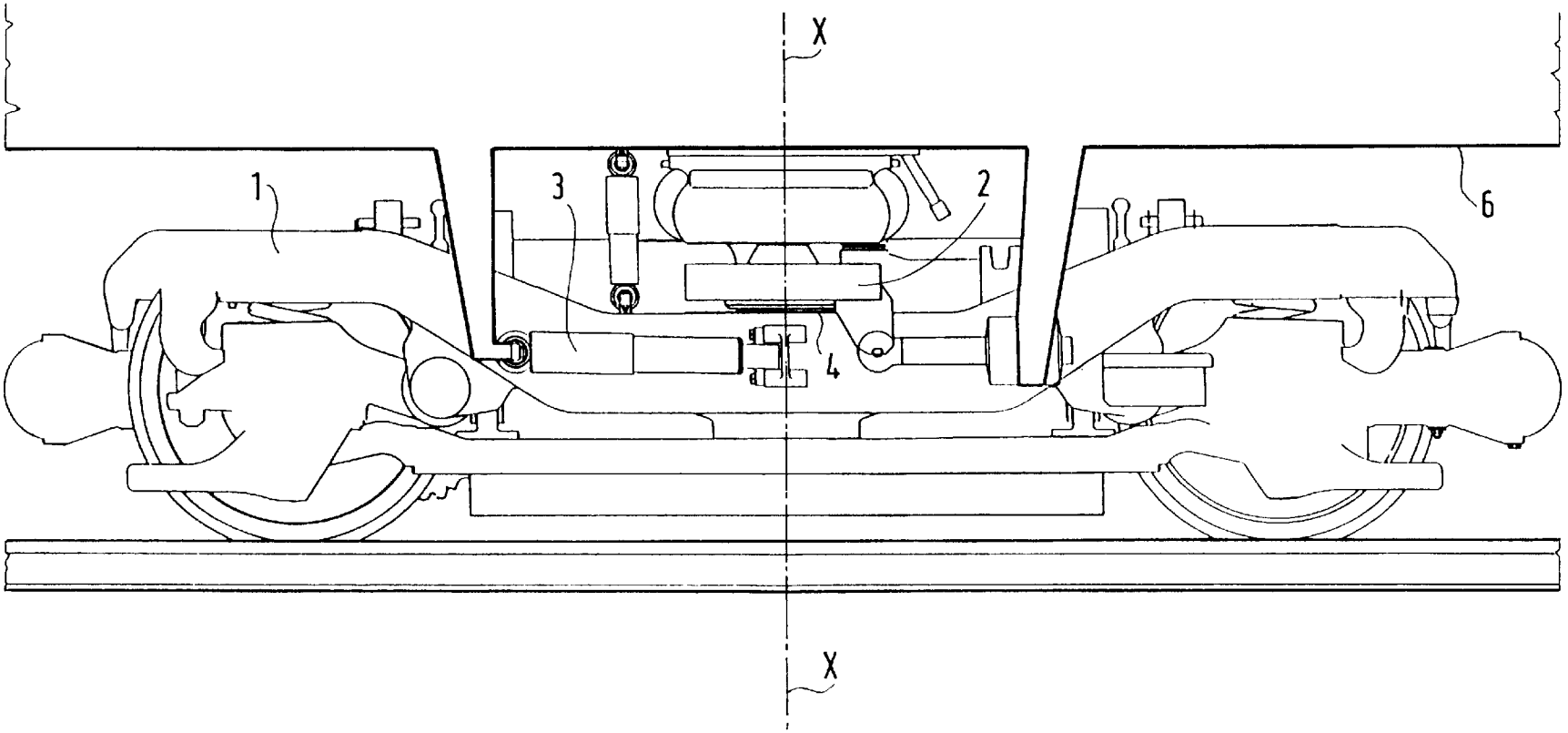
FIG. 1 is a side view of the motor bogie of the invention.
Figure 2:
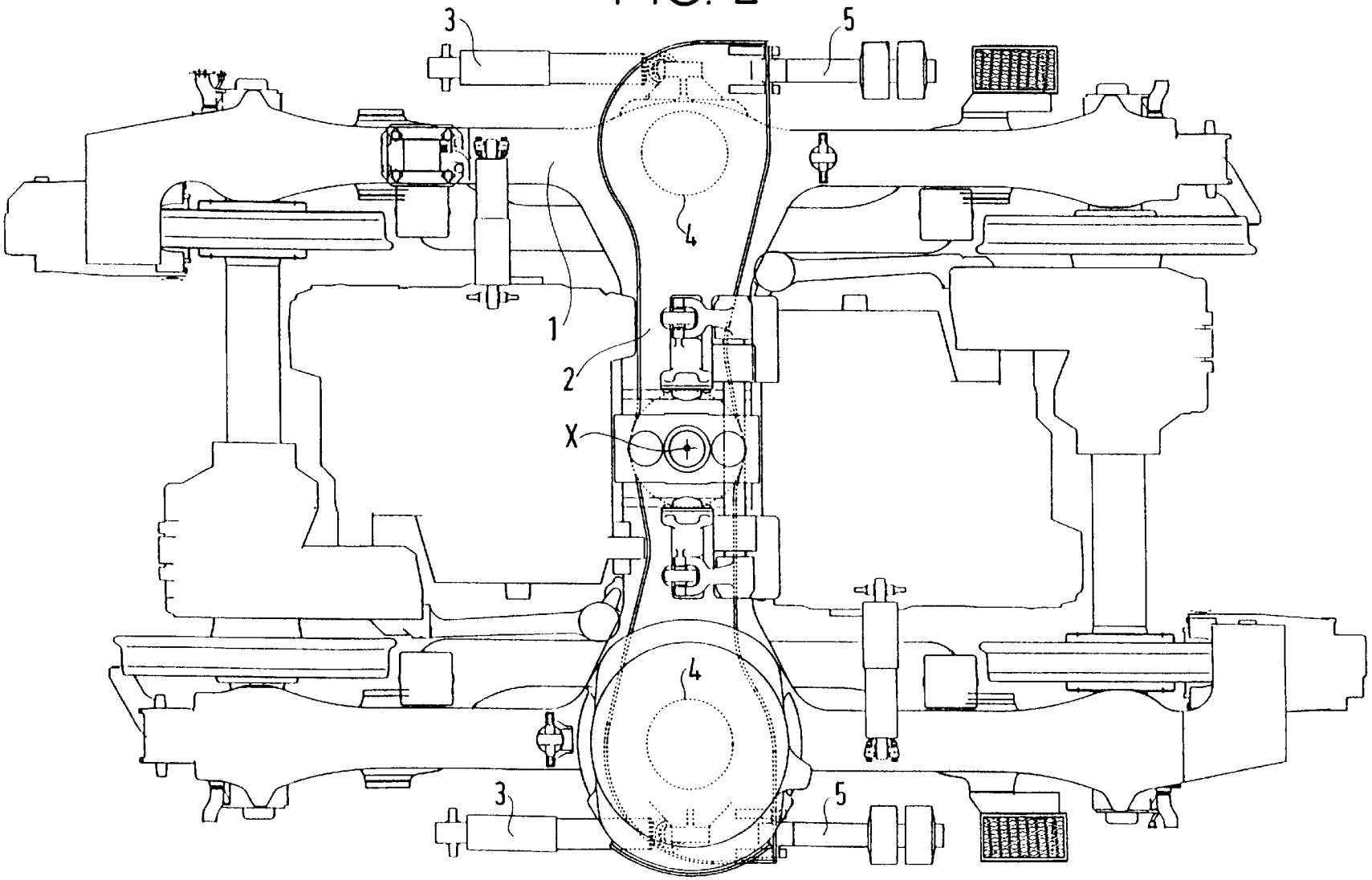
FIG. 2 is a plan view of the motor bogie of the invention.

The architecture of the motor bogie of the invention as shown in FIGS. 1 and 2 is implemented at the level of the secondary stage by a crossbeam 2 adapted to pivot relative to the chassis 1 of the bogie about a vertical axis X—X.

The crossbeam 2 bears on a side friction block 4 and is rotationally coupled to the body 6 mounted on the motor bogie by links 5.

The anti-yaw torque is obtained by virtue of the rotation of the chassis 1 relative to the crossbeam 2 by introducing into the chassis/body coupling a friction torque developed by the side friction blocks 4.

An additional coupling is provided between the chassis 1 and the body 6 by means of an anti-yaw damper 3.

The characteristic of the anti-yaw damper 3 is adjusted for safe operation of the bogie.

In normal operation the anti-yaw torque is provided by the crossbeam rubbing on the side friction block.

Above a threshold of relative angular velocity between the body and the chassis, the anti-yaw dampers generate an additional anti-yaw torque.

There is claimed:

1. A motor bogie comprising:

a bogie chassis supporting a side friction block; a crossbeam mounted on said bogie chassis for rotation about a vertical axis relative to said bogie chassis, said crossbeam bearing on said side friction block; and a body mounted on said motor bogie and rotationally coupled to said crossbeam; and an anti-yaw damper coupling said chassis to said body.

2. The bogie claimed in claim 1, wherein a rotation of said chassis relative to said crossbeam causes said side friction block to rub against said cross beam, thereby generating a friction torque acting against said rotation.

3. The bogie claimed in claim 1 wherein a characteristic of said anti-yaw damper is adjustable.

4. The bogie claimed in claim 2, wherein said friction torque is a first anti-yaw torque, to which is added a second anti-yaw torque produced by said anti-yaw damper when a relative angular speed between said body and said chassis exceeds a predetermined threshold.

* * * * *